US009579770B2

(12) United States Patent
Pierednik et al.

(10) Patent No.: US 9,579,770 B2
(45) Date of Patent: Feb. 28, 2017

(54) DEVICE AND METHOD FOR GRINDING WORKPIECES USING A CONTROL UNIT

(71) Applicant: Matuschek Messtechnik GmbH, Alsdorf (DE)

(72) Inventors: Christoph Pierednik, Aachen (DE); Elmar Lange, Gummersbach (DE); Joerg Weinhardt, Niederzier (DE)

(73) Assignee: Matuschek Messtechnik GmbH, Alsdorf (DE)

( * ) Notice: Subject to any disclaimer, the term of this patent is extended or adjusted under 35 U.S.C. 154(b) by 178 days.

(21) Appl. No.: 14/602,489

(22) Filed: Jan. 22, 2015

(65) Prior Publication Data

US 2015/0239092 A1 Aug. 27, 2015

(30) Foreign Application Priority Data

Feb. 25, 2014 (DE) ..... 10 2014 203 409

(51) Int. Cl.
*B24B 5/24* (2006.01)
*B24B 41/04* (2006.01)
*B24B 45/00* (2006.01)

(52) U.S. Cl.
CPC ..... *B24B 41/04* (2013.01); *B24B 45/00* (2013.01)

(58) Field of Classification Search
CPC ..... B24B 5/24; B24B 19/16; B23K 11/30; B23K 11/3063

(Continued)

(56) References Cited

U.S. PATENT DOCUMENTS 2,300,173 A * 10/1942 Platz ..... B23K 11/3063 451/439
2,357,038 A * 8/1944 Whitesell, Jr. ..... B23K 11/3063 200/50.32

(Continued)

FOREIGN PATENT DOCUMENTS

| | | | |
|---|---|---|---|
| BE | 1011809 | A3 | 1/2000 |
| DE | 169150 | | 3/1906 |
| DE | 204783 | | 12/1908 |
| DE | 212039 | | 7/1909 |
| DE | 310379 | | 1/1919 |
| DE | 1 137 974 | | 10/1962 |
| DE | 1 925 720 | U | 10/1965 |
| DE | 1 955 787 | | 2/1967 |
| DE | 31 25 915 | A1 | 1/1983 |
| DE | 227 073 | B1 | 9/1985 |
| DE | 297 13 087 | U1 | 10/1997 |
| DE | 197 20 233 | A1 | 11/1997 |
| DE | 199 21 003 | C2 | 11/1999 |
| DE | 199 52 183 | A1 | 5/2001 |
| DE | 10 2009 044 855 | A1 | 6/2011 |
| DE | 10 2012 221 553 | A1 | 5/2014 |
| EP | 0 385 069 | B1 | 9/1990 |
| EP | 0 589 565 | A2 | 3/1994 |
| EP | 0 844 040 | B1 | 5/1998 |
| EP | 0 867 253 | B1 | 9/1998 |
| EP | 1 005 942 | A1 | 6/2000 |
| EP | 1 270 134 | B1 | 8/2006 |

(Continued)

OTHER PUBLICATIONS

A.M.D.P., "User'S Manual Fixed to the Ground Electrodes'Gyrobuffer," Mar. 2007, 11 pgs.

*Primary Examiner* — Robert Rose
(74) *Attorney, Agent, or Firm* — Muirhead and Saturnelli, LLC

(57) ABSTRACT

A system for grinding solid workpieces includes a grinding wheel, a bearing for rotatable mounting of the grinding wheel about an axis of rotation, and a grinding wheel drive for rotating the grinding wheel. The system allows the production of freely-definable surfaces on the face of the rigid workpiece that comes into contact with the grinding wheel. The bearing is fastened to a pivotable and displaceable bearing carrier. The bearing plane is pivotable in any desired direction with respect to an initial plane and is displaceable in a direction perpendicular to the initial plane. Actuators are coupled to the bearing carrier to pivot and displace the bearing carrier. A digital control unit controls and synchronizes the actuators such that the surface of the grinding wheel creates a freely-definable face about a positionally fixed reference point which is at a radial distance from the center point of the grinding wheel.

15 Claims, 10 Drawing Sheets

(58) Field of Classification Search
USPC .... 451/259, 278, 262, 270, 160, 28, 5, 8–10
See application file for complete search history.

(56) References Cited

U.S. PATENT DOCUMENTS

| | | | | |
|---|---|---|---|---|
| 5,001,868 | A * | 3/1991 | Jankus | B24B 19/16 451/285 |
| 5,288,185 | A * | 2/1994 | Mattsson | B23B 5/166 219/119 |
| 5,740,699 | A | 4/1998 | Ballantyne et al. | |
| 5,934,976 | A | 8/1999 | Makino | |
| 5,980,360 | A | 11/1999 | Murray et al. | |
| 6,195,860 | B1 * | 3/2001 | Di Rosa | B23K 11/3063 29/33 R |
| 7,458,139 | B2 * | 12/2008 | Nakazima | B23B 5/166 219/119 |
| 9,022,838 | B2 * | 5/2015 | Tamm | B24B 19/16 451/294 |
| 2013/0288580 | A1 | 10/2013 | Tamm | |

FOREIGN PATENT DOCUMENTS

| | | |
|---|---|---|
| FR | 2 738 518 | 3/1997 |
| FR | 2 756 202 | 5/1998 |
| FR | 2 761 285 | 10/1998 |

* cited by examiner

X. - X.

XII.-XII.

DEVICE AND METHOD FOR GRINDING WORKPIECES USING A CONTROL UNIT

TECHNICAL FIELD

This application relates to the field of grinding solid workpieces.

BACKGROUND OF THE INVENTION

In order to grind the ends of flexible bristles of brushes, the document DE 297 13 087 U1, which is incorporated herein by reference, discloses a device in which a conical grinding wheel rotates about an axis of rotation and at the same time is rotatable in a manner revolving about a second axis extending obliquely with respect to the axis of rotation. The angle of slant of the second axis corresponds to the angle of taper of the grinding wheel, and the flexible bristles are pressed against the grinding wheel substantially at the intersecting point of the second axis with the surface of the grinding wheel. This results substantially in a horizontally extending surface of the grinding wheel in contact with the bristles because of the angle of slant and angle of taper being identical in value when the second axis extends vertically. Using the revolving turning of the grinding wheel, the direction of the grinding movement of the surface of the grinding wheel can be changed continuously, such that the ends of the flexible bristles, which are bent in the direction of rotation of the grinding wheel by the latter, are ground from all sides, and a grinding result with bristle ends which are approximately hemispherically rounded is produced. However, such a procedure is impossible in the case of solid, non-flexible workpieces, since the latter are not bent by the grinding force.

During the resistance welding of metal sheets, electric currents with a high current strength are introduced into the sheets by two electrodes pressed against the outer surfaces of the sheets to be welded to each other. The metal of the sheets is melted and forms a weld nugget which connects the pressed-together sheets fixedly to each other. The welding electrodes are customarily composed of copper or copper alloys.

In particular in the case of aluminum resistance welding, the ideal shape and the cleanliness of the surface of the welding electrodes are a substantial prerequisite for producing a spot weld of high and reproducible quality. The surfaces of the welding electrodes can be impaired by deposits and wear even by welding a few spot welds, for example ten to twenty spot welds, such that the spot welds produced do not have the desired strength.

For this reason, welding electrodes are reworked at regular intervals such that the surfaces thereof have an optimum shape and are free from contaminations during each welding operation. A known method for reworking the surfaces of the welding electrodes is the grinding of the welding electrodes.

The company AMDP S.A.S. from Croissy-sur-Seine provides a grinding device for welding electrodes, in which a flat grinding wheel is fastened to a rigid rotary spindle which is set into rotation by a drive motor. The drive motor is located in a housing, the upper end of which is fastened pivotably to a frame. A wobble-type drive moves the lower end of the housing on a circular path, such that the rotary spindle accommodated in the housing executes a wobbling movement in order to produce a conical electrode surface on the electrode with the grinding wheel. This device has a positionally fixed position of the wobbling grinding wheel, such that the welding electrodes have to be pressed against the grinding wheel, for example using a robot arm carrying the welding tongs with the electrodes, for the machining. This requires highly complicated programming of the robot arm.

Accordingly, it would be desirable to provide an improved device and a method of the above-mentioned type for rigid workpieces, which automatically allow the production of freely-definable surfaces on that face of the rigid workpiece that comes into contact with the grinding wheel. If the machined workpiece is a welding electrode, the device and the method are intended to permit, at as high a speed as possible, the production of a rotationally symmetrical convex and in particular conical or cap-shaped electrode surface, which is optimally suitable for the welding operation.

SUMMARY OF THE INVENTION

According to the system described, a device for grinding solid workpieces has a grinding wheel, a first bearing for the rotatable mounting of the grinding wheel about a first axis of rotation, and a grinding wheel drive, which is coupled to the grinding wheel, for rotating the grinding wheel.

According further to the system described herein, a method for grinding solid workpieces, in which a grinding wheel is set into rotation about a first axis of rotation by a grinding wheel drive, and the grinding wheel is mounted in a first bearing so as to be rotatable about the first axis of rotation.

The grinding wheel may be provided with a flat grinding surface on the side facing away from the bearing or with two flat grinding surfaces on both sides. However, the grinding surfaces can also differ from flat faces.

In other words, the machine-side bearing shell of the bearing, which mounts the grinding wheel in a rotatable manner about its axis of symmetry, is fastened to a bearing carrier such that its plane can be pivoted in all directions. The bearing shell is furthermore fastened so as to be displaceable in one direction. The direction of displacement of the bearing shell is designated the initial direction. The pivotability of the bearing plane in all directions relates to an initial plane which is perpendicular to the initial direction. In particular for machining welding electrodes, pivoting only within a limited angular range of less than 20°, in practice usually less than 10°, has to be allowed with respect to the initial plane. For other applications, a larger pivot angle can be selected. The device comprises actuators for pivoting and displacing the bearing carrier, and a digital control unit which controls and synchronizes the actuators such that the surface of the grinding wheel creates a freely defined face about a positionally fixed reference point which is at a radial distance from the center point of the grinding wheel. This means that the workpiece can be moved toward the reference point, parallel to the initial direction, until the end side of the workpiece comes into contact with the grinding wheel in the region of the reference point. The control unit controls and synchronizes the actuators such that the contact region between the grinding wheel and the end face of the workpiece produces a face that is predetermined with regard to the end face of the workpiece and is freely definable within the scope of the possible freedom of movement of the bearing carrier.

In the case of a welding electrode, the end face, resting against the grinding wheel, of the workpiece is brought into a convex shape that is rotationally symmetrical with respect to the reference point and the center axis of the workpiece. The end faces of welding electrodes are generally formed in a slightly conical or spherical manner.

However, on account of the bearing plane pivoting in any desired direction and the bearing being displaced in a synchronized manner parallel to the initial direction, any desired setting angle and any desired contact plane can be set at any time within the pivoting range and displacement range. The face produced by the surface of the grinding wheel can thus be freely defined within the pivoting and displacement ranges. For example, this face can be formed in a pyramidal manner. The actuators are then, for example in the case of a trihedral pyramid, moved toward the workpiece in three discrete inclination positions of the bearing plane. In order to adjust the bearing plane, the grinding wheel is moved away from the workpiece. Once the new bearing plane has been adopted, the grinding wheel is moved toward the workpiece again by the displacement movement. In this way, a tetrahedral pyramid or a faceted face can also be produced on the end side of the workpiece.

When a rotationally symmetrical face is produced, unlike in the case of the grinding device from the company AMDP S.A.S., the angle of the surface of the grinding wheel is not inevitably predetermined by a wobbling movement of the housing of the grinding device but is set by the digital control unit.

The drive motors which effect the pivoting and displacement are stepper motors, the actuation of which can be controlled very precisely by the digital control unit. For each revolution of the motor shaft, the actuators emit a number of signals to the digital control unit such that the digital control unit is informed at all times about the magnitude and direction of the rotary movement of each of the actuators. The actuators can be connected to the bearing carrier via reducing gears, for example screw spindles or ball screws, such that every revolution of one of the actuators effects only a slight change in the position of the bearing carrier. In this way, the control of the movement of the grinding wheel by the actuators is very precise.

In practice, each actuator can have a reference position in which the control unit receives a reference signal and from which the control unit controls the actuation of the respective actuator. The reference position can be either a stop for the respective actuator at the end of its adjustment travel or a position, for example in the middle of the adjustment travel, in which a transducer transmits a signal to the control unit.

In order to produce a rotationally symmetrical face, the synchronization of the actuators in order to pivot the bearing carrier can take place for example such that the bearing plane is at a constant inclination angle to the initial plane, said inclination angle shifting circumferentially, however. In other words, the axis of rotation of the bearing is at a constant angle to the initial direction, wherein this inclined position changes circumferentially such that during one revolution, the axis of rotation defines a cone of which the axis of symmetry extends parallel to the initial direction. The actuator or actuators for displacing the bearing carrier are in this case operated such that the grinding wheel is in contact with the end face of the workpiece at any time in the given contact region close to the positionally fixed reference point, in order to form the desired rotationally symmetrical convex face of this end face. In the case of simple cyclical pivoting of the bearing axis along a cone having a cone axis parallel to the initial direction, an axial movement of the contact region of the grinding wheel toward and away from the workpiece would take place at every reference point at a radial distance from the center point of the grinding wheel. On account of the synchronous displacement of the bearing carrier, this axial movement is compensated and the bearing carrier is guided such that the contact region of the surface of the grinding wheel with the workpiece is located on the desired rotationally symmetrical face.

In this case, care should be taken to ensure that at the start of the grinding operation the surface of the workpiece can deviate from the desired face. The grinding wheel should therefore be configured or held in a flexible manner such that its surface has a degree of resilience. To this end, the material of the grinding wheel can be elastically deformable such that it deflects at the start of the grinding operation until the end face of the workpiece has assumed the desired rotationally symmetrical face. Alternatively, the bearing carrier can be held in an elastic manner such that it can be pushed out of the nominal position by the workpiece at the start of the grinding operation until that surface of the workpiece that is in contact with the grinding wheel has assumed the desired shape. Such elastic bearing can be incorporated in the grinding wheel drive. The grinding wheel drive can be a hub motor, the external rotor of which is connected to the grinding wheel in a torque-proof manner. The magnetic elements of the internal stator and the external rotor can be arranged in such a manner that the rotor is kept in a stable axial position with respect to the stator by the magnetic forces and may be pushed out of this stable axial position in the axial direction against a magnetic counter force that pushes the rotor back to its stable position. Thus, the magnetic elements of the stator and the rotor provide for a magnetic spring and the rotor with the grinding wheel can be pushed out of its stable position in an axial direction in case of excessive axial grinding forces. This magnetic resilience may be softer than the resilience of the elastically deformable grinding wheel. Of course, the magnetic resilience and the elastically deformable grinding wheel may both be used in the same device to provide for a sufficiently resilient grinding surface.

Of course, the displacement movement brought about by the control unit can also take place such that the deviation from the desired face is compensated.

Compared with the fixed forced movement of the mounting of the grinding wheel using a wobble-type device, the proposed free pivotability and displaceability of the bearing carrier with respect to an initial position (grinding wheel is located parallel to the initial plane) has a number of advantages in practice. Firstly, the structural design of the adjustable fastening of the bearing carrier can be kept quite simple. Furthermore, imbalances which result from the movement of large masses are avoided. Moreover, as a result of the free pivotability and displaceability of the bearing carrier, great variability with regard to grinding itself can be achieved. In the event of a positively controlled movement of the bearing of the grinding wheel, this bearing moves on a fixedly predetermined path. Consequently, the grinding wheel wobbles constantly around the desired rotationally symmetrical face. Each region of the rotationally symmetrical face to be produced is in this case machined with the same intensity. In the case of the novel selective free pivotability and displaceability according to the proposal described here, different regions of the face to be produced can be machined with different intensities. For example, during machining, the torque of the grinding wheel drive can be measured. A high torque suggests a high degree of material removal. This is an indication that the surface of the workpiece is deviating considerably from the profile of the face to be produced. The adjustment movement of the actuators can consequently take place such that the contact region is initially located where a high torque of the grinding wheel drive is measured. Thus, only those regions of the workpiece that have the greatest shape deviations from the desired surface are machined. The actuators can then move the bearing carrier further when this torque has dropped, until a uniform low torque prevails in the entire adjustment range and the workpiece surface corresponds to the desired surface which is defined by the movement of the grinding wheel.

Moreover, in the case of a positively controlled wobbling movement of the grinding wheel, the reference point is usually located in a fixed position in space. In the case of the device described here, the reference point can, by contrast, be selected as desired within the contour of the grinding wheel. In the event of a shift of the reference point, only the displacement movement has to be adapted such that it compensates the shift of the grinding wheel surface, brought about by the pivoting of the grinding wheel, in the initial direction. As a result, successive workpieces can be machined by different regions of the grinding wheel such that the grinding wheel can be utilized uniformly over a large region of its diameter.

As a result of the free pivotability and displaceability, the faces produced by the grinding wheel can be freely defined. For example, the longitudinal axes of welding electrodes in many welding tongs are inclined with respect to one another in the open position. This known inclined position can be taken into account by the programming of the control unit such that on each of the welding electrodes a face that is rotationally symmetrical to the longitudinal axis thereof is produced.

The bearing carrier can be fastened in any desired manner as long as it is freely pivotable with respect to the initial plane and is displaceable in the initial direction. In one practical embodiment, a pivot joint can be used for the pivotable mounting of the bearing plane. To this end, in particular a universal joint or a ball joint is suitable. The universal joint, also referred to as a Cardan joint, has two intersecting pivot axes about which the bearing carrier is pivotable. The pivot joint is to be fastened in a displaceable manner on a machine frame, wherein the reference point is in a fixed position with respect to the frame.

The actuators can have a first inclination adjustment drive which effects the pivoting of the bearing about the first of the pivot axes of the universal joint. They can have a second inclination adjustment drive which effects the pivoting of the bearing about the second of the pivot axes of the universal joint. And they can also have a linearly acting drive which displaces the bearing carrier. The linearly acting drive may displace the entire fastening arrangement for the bearing carrier having the universal joint and the two inclination adjustment drives. The inclination adjustment drives may be for example stepper motors, the motor shaft of which drives a threaded spindle or ball screw which changes the inclination of the bearing carrier with respect to the respective axis, assigned to the inclination adjustment drive, of the universal joint. The linearly acting drive can likewise turn a threaded spindle which moves a threaded nut, to which a plate having the pivot drives and the pivot bearing is fastened, back and forth in the axial direction.

The universal joint may be formed in a symmetrical manner with respect to the initial plane, i.e. the two pivot axes of the universal joint extend parallel to the initial plane when the bearing plane extends parallel to the initial plane. Furthermore, the universal joint may be formed such that the maximum pivot angle with respect to the initial plane is the same size in all directions.

Alternatively to the universal joint, a ball joint can hold the bearing carrier in a pivotable manner, with the actuators having the same function.

The bearing carrier can be moved in the manner of a swash plate. A swash plate is known for example from helicopter construction. Each rotor blade of a helicopter is coupled to the swash plate via a pitch control rod. By raising and lowering the swash plate, the angles of attack of all the rotor blades are changed collectively. This means that in the event of a parallel displacement of the swash plate, the inclined position of all of the rotor blades is changed by the same degree in each rotary position of the rotor. In the event of pivoting of the swash plate, the variation in the angle of attack of each rotor blade is changed during a revolution about the rotor axis. Depending on the desired direction of flight and change in direction, the rotor blade has to generate greater lift toward the front, rear, right or left and consequently have a larger angle of attack. The inclined position of the swash plate specifies in which angular position with respect to the direction of flight the angle of attack of the rotor blade is at a maximum.

In the context of the system described herein, however, it may be provided that only the movement of the swash plate is significant, and not its function during the change in angle of attack of rotor blades.

A swash plate is displaceable along a center axis extending in the initial direction and is freely pivotable with respect to an initial plane extending at right angles to the initial direction. In this case, the swash plate is mounted so as to be freely pivotable for example using a ball joint. Swash plate drives usually have three driven actuating rods. Three fastening elements, which are arranged at a distance from one another and on each of which an actuating rod that is connected to an actuator acts, are provided on the swash plate. The fastening elements are arranged as regularly as possible in different radial positions with respect to the center axis of the swash plate. All three fastening elements may be at the same distance from the center axis of the swash plate, the second fastening element has been shifted through 120° with respect to the first fastening element in a defined direction of rotation about the center axis, and the third fastening element has been shifted through 240° with respect to the first fastening element. In other words, the three fastening elements are located at the tips of an equilateral triangle, the center of gravity of which is located on the center axis of the swash plate. The three fastening points of the three fastening elements define at any time the plane of the swash plate. Each of the fastening elements is connected to an actuator via a connecting rod. A threaded rod driven by a stepper motor is again suitable as actuator.

As a result of the actuation of one of the three actuators, the fastening element assigned to said actuator is shifted in the direction of the actuating rod such that the swash plate pivots. If all three actuators are actuated simultaneously, the swash plate can be displaced and pivoted. In practice, the swash plate can be mounted on a pivot joint (e.g. ball joint) of which the displacement is guided by a guide rod that extends in the initial direction. The pivot angle of the pivot joint is in practice structurally limited. Consequently, the swash plate can be shifted by actuation of the actuators in the axial direction of the guide rod and pivoted in a predetermined angular range about an initial plane which extends perpendicularly to the guide rod.

In practice, each of the fastening elements can be displaceable parallel to the initial direction by the actuating rod fastened therein using the actuator, when the bearing plane extends parallel to the initial plane. The initial direction can in practice extend parallel to the guide rod. In other words, each actuator shifts the fastening element assigned thereto parallel to the initial direction when the plane of the swash plate is oriented parallel to the initial plane. These geometrical preconditions result in relatively easy calculations for changing the position of the swash plate in dependence on the particular actuation of the actuators. The geometrical relationships and the kinematics of the drive elements can also be different, however. It is merely necessary for the geometric relationships to be known during programming such that, for each adjusting movement of each of the actuators, the change in position of the grinding wheel is known and the actuators can be controlled in a synchronized manner such that the surface of the grinding wheel mounted on the swash plate comes into contact with the end face of the workpiece in each case in a predetermined contact region which is located on the freely-definable face.

However other designs of the drives of swash plates, which effect the pivoting about the initial plane and the displacement in the initial direction and can be used in the present development, are also known.

The grinding wheel drive can be a hub motor, the external rotor of which is connected to the grinding wheel in a torque-proof manner. However, any other drive device for rotating the grinding wheel can also be used. For example, a flexible shaft can couple a motor arranged on the machine frame to the grinding wheel.

BRIEF DESCRIPTION OF THE DRAWINGS

Embodiments of the system described herein are explained in the following text with reference to the appended drawings.

DETAILED DESCRIPTION OF VARIOUS EMBODIMENTS

Figure 1:
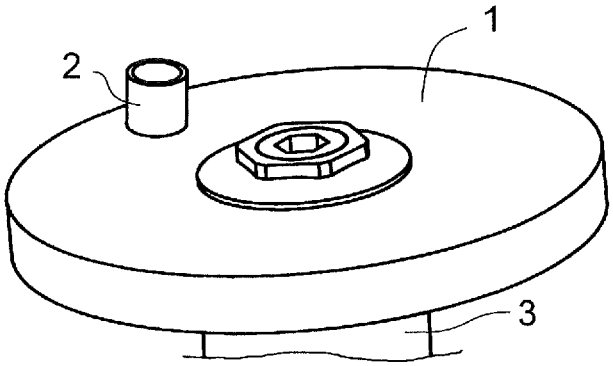
FIGS. 1 to 4 show a perspective illustration and three sectional illustrations of the grinding wheel and of a workpiece of the grinding device described here.

FIGS. 1 to 4 illustrate the grinding that is desired with the grinding device described here. The grinding wheel 1 and the workpiece 2 are depicted here. The grinding wheel 1 is configured in a flat manner, i.e. it has two mutually parallel grinding surfaces. In the illustration shown, the workpiece 2 is a copper welding electrode. The welding electrode 2 is drawn in an exposed manner. In practice, it is moved to the grinding wheel 1 by welding tongs fastened to a robot arm. The grinding wheel 1 may include an elastic, optionally foamed plastics material, to the disk-like top side and underside of which abrasives have been applied. However, rigid grinding wheels 1 are also used. The grinding wheel 1 is fixedly screwed to a hub 3 which is pivotable and displaceable in the present grinding device.

Figure 2:
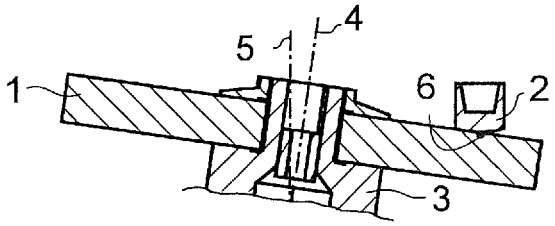
Figure 3:
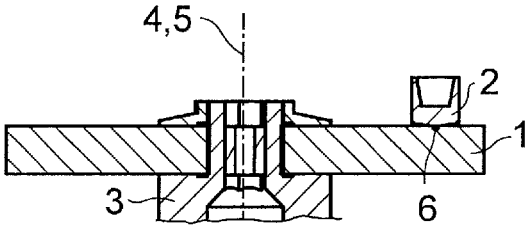
Figure 4:
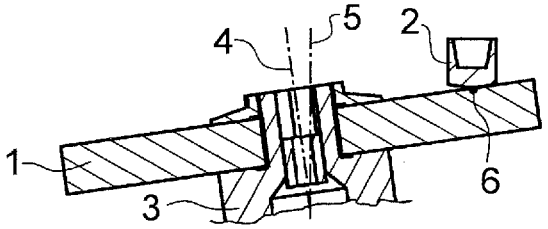
Figure 5:
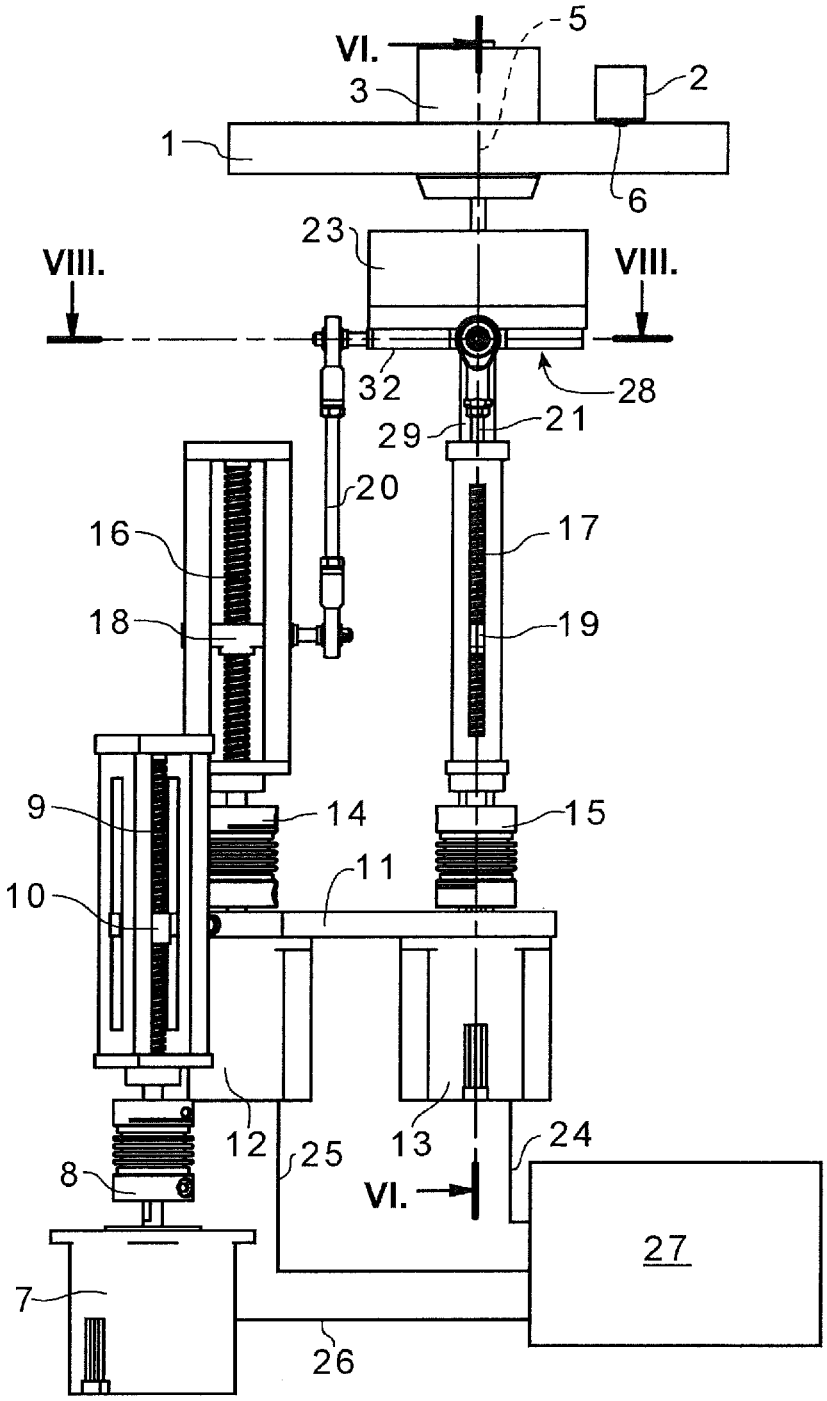
FIG. 5 shows a side view of a first embodiment of the grinding device described here.
Figure 6:
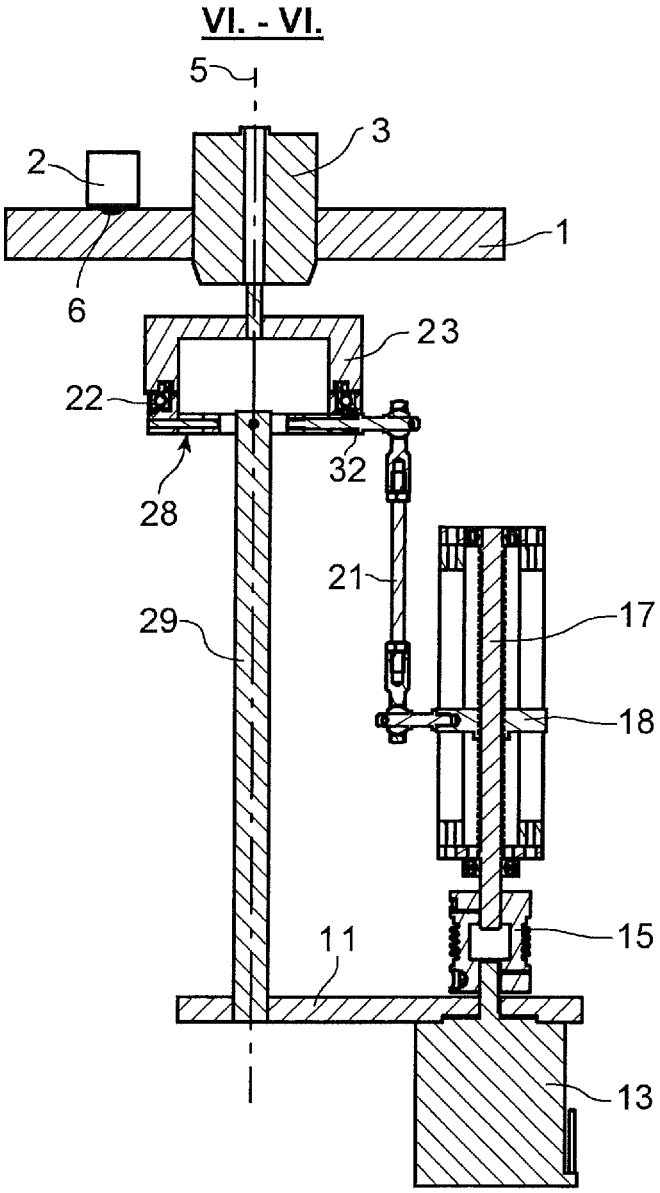
FIG. 6 shows a sectional view of the grinding device from FIG. 5 along the section line VI-VI.
Figure 7:
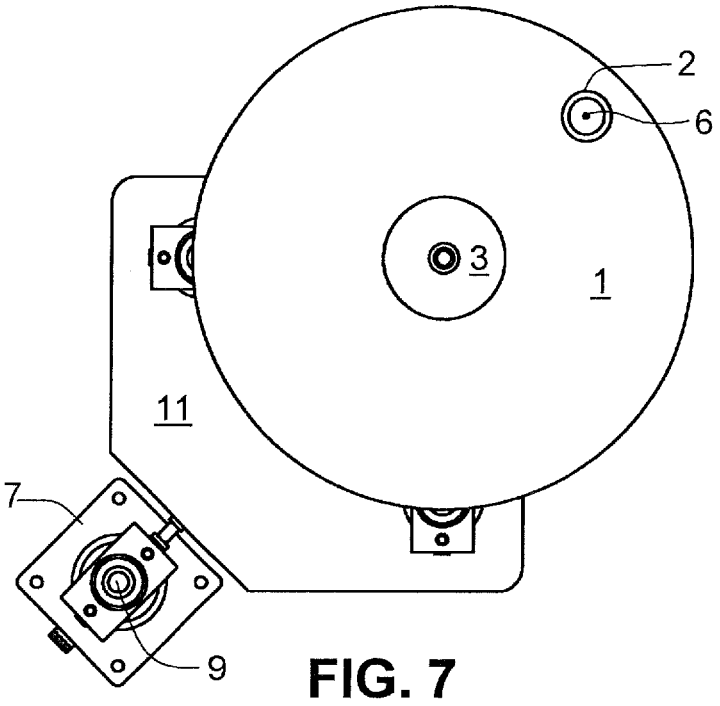
FIG. 7 shows a plan view and FIG. 8 shows an illustration in section along section line VIII-VIII of the grinding device from FIG. 5.

The axis of rotation of the bearing of the grinding wheel is provided with the reference number 4 in FIGS. 2 to 4. The bearing itself is not illustrated.

The vertical direction in which the grinding wheel 1 is displaceable is provided with the reference number 5 in FIGS. 2 to 4. The vertical direction 5 in FIGS. 2 to 4 corresponds to the initial direction. It should be noted that the initial direction can be selected to be in any desired position. The workpiece 2 is then intended to be moved in a corresponding position onto the grinding face of the grinding wheel 1. The relative position of the components of the grinding device is pivoted in a corresponding manner when the initial direction 5 is pivoted.

It can be gathered in particular from FIGS. 2 and 3 that, in order to create a rotationally symmetrical, spherical surface on the workpiece 2, the axis of rotation of the mounting of the grinding wheel 1 is pivotable with respect to the vertical initial direction 5. In this case, the axis of rotation 4 is pivotable not only in the plane drawn in FIGS. 2, 3 and 4, but also perpendicularly thereto and in any desired other directions. The grinding wheel 1 is held such that the axis of rotation 4 is freely pivotable within a conical adjustment region about the initial direction 5. At the same time, the grinding wheel 1 is displaceable in the vertical initial direction 5. The pivoting movements and displacement movements are synchronized such that the grinding wheel 1 is in contact with the surface of the workpiece 2 in the vicinity of a reference point 6. On account of the pivotability of the grinding wheel 1, the grinding wheel 1 can produce a spherical or conical surface on the end side of the workpiece 2. During the machining operation, the workpiece 2 remains in a fixed position with respect to the machine frame of the grinding device, and so the reference point 6 is in a fixed position.

The reference point 6 is at a radial distance from the center point of the grinding wheel 1. On account of this radial distance, a shift of the reference point 6 in the initial direction 5, which is compensated by a shift in the mounting of the grinding wheel 1, results from the pivoting of the grinding wheel 1. The displacement movement and pivoting movement of the grinding wheel 1 are synchronized with one another such that the surface of the grinding wheel 1 is always in contact with the workpiece 2 in the vicinity of the reference point 6. This permits generating a wobbling movement of the grinding wheel 1, which produces a conical surface or a surface in the form of a spherical cap on the end side of the workpiece 2 in the region of the reference point 6.

The surface of the workpiece 2 does not have to be ground in a rotationally symmetrical manner. As a result of the free pivoting and displacement of the grinding wheel 1, any desired shapes of the end side of the workpiece 2 can be realized in the pivoting range and displacement range of the grinding wheel 1.

FIGS. 5 to 8 show a first embodiment of the pivoting and displacement drives for the grinding wheel 1.

A first stepper motor 7 is connected to a threaded spindle 9 via a metal bellows coupling 8. On the threaded spindle 9 there runs a spindle nut 10 which is moved up and down when the threaded spindle 9 rotates. The stepper motor 7 and threaded spindle 9 are fastened to a positionally fixed machine frame (not illustrated). The first stepper motor 7 effects displacement in the vertical initial direction 5. Fastened to the spindle nut 10 is a support plate 11 which carries the pivot drives. If the friction of the threaded spindle 9 is intended to be minimized, the latter can be configured as a ball screw having a ball nut as spindle nut 10. Alternatively, it is possible to use a self-locking trapezoidal spindle such that the weight forces of the device cannot cause any malpositioning of the threaded spindle 9. The same goes for the threaded spindles described below. The metal bellows coupling 8 compensates an axial offset or angular offset between the motor shaft and the threaded spindle 9.

Two further stepper motors 12, 13 are flanged on the underside of the support plate 11. Each of these stepper motors 12, 13 is connected via a respective metal bellows coupling 14, 15 to in each case one further threaded spindle 16, 17. The stepper motor 12 drives the rotary movement of the threaded spindle 16 via the metal bellows coupling 14, such that the spindle nut 18 is moved up or down in the vertical direction. The stepper motor 13 drives the threaded spindle 17 via the metal bellows coupling 15 in order to displace the spindle nut 19. Each of the two spindle nuts 18, 19 is connected to a bearing carrier via an actuating rod 20, 21. An external joint ring 32 of a universal joint 28 forms the bearing carrier in the embodiment in FIGS. 5 to 8. The bearing carrier 32 carries a bearing 22 for the rotor 23 of a hub motor which drives the grinding wheel 1. Further components of the hub motor are not illustrated for reasons of clarity. The rotor 23 is connected to the hub 3 of the grinding wheel 1 in a torque-proof manner. The bearing 22 is illustrated here as a simple ball bearing. However, any suitable bearing, in particular a roller bearing, can be used.

The bearing carrier 32 can be pivoted in any desired directions with respect to a horizontally extending initial plane via the universal joint 28 described in more detail in the following text.

All of the stepper motors 7, 12, 13 are connected to a control unit 27 via control lines 24, 25, 26. The control unit 27 is illustrated only in FIG. 5 and not in FIGS. 6 to 8. It can be formed by any suitable data processing device. In practice, a programmable logic controller (PLC) or a microcontroller is usually used in order to control the stepper motors 7, 12, 13. The stepper motors 7, 12, 13 can be controlled such that, via the control unit 27, in each case a precise predetermined position of the spindle nut 10, 18 and 19 can be set. The same result can also be achieved with servomotors.

Figure 8:
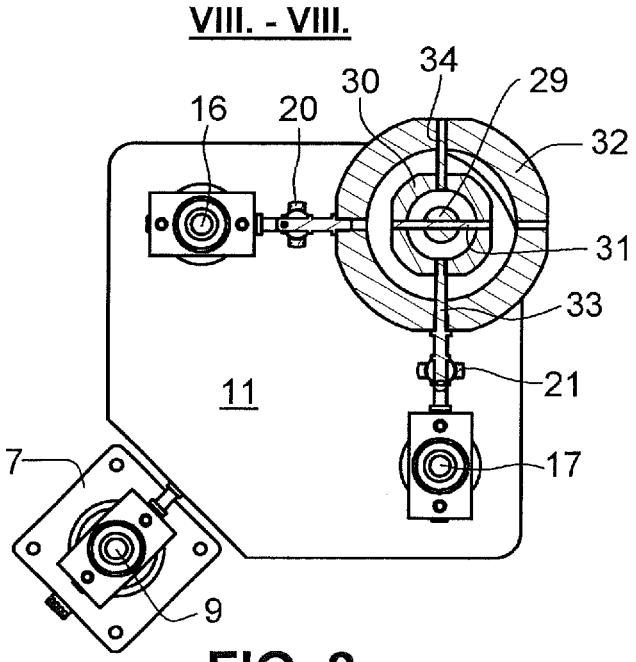
Figure 9:
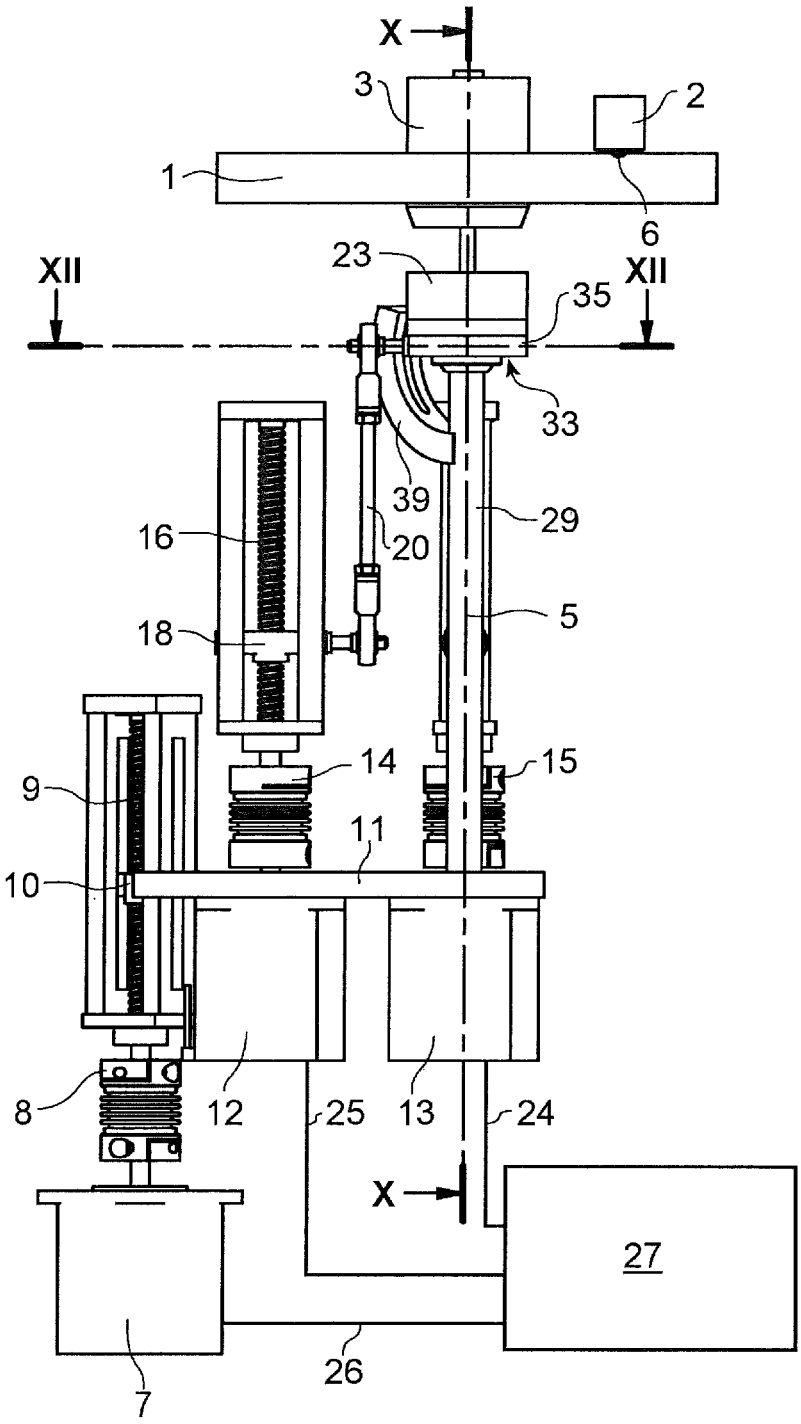
FIG. 9 shows a side view of a second embodiment of the grinding device described here.
Figure 10:
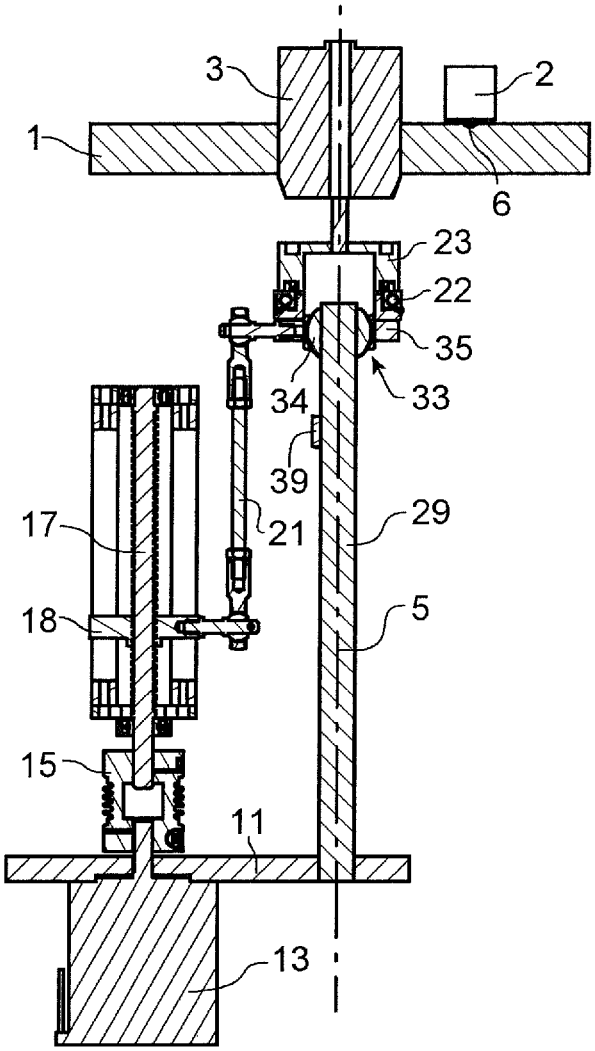
FIG. 10 shows an illustration in section along section line X-X of the grinding device from FIG. 9.
Figure 11:
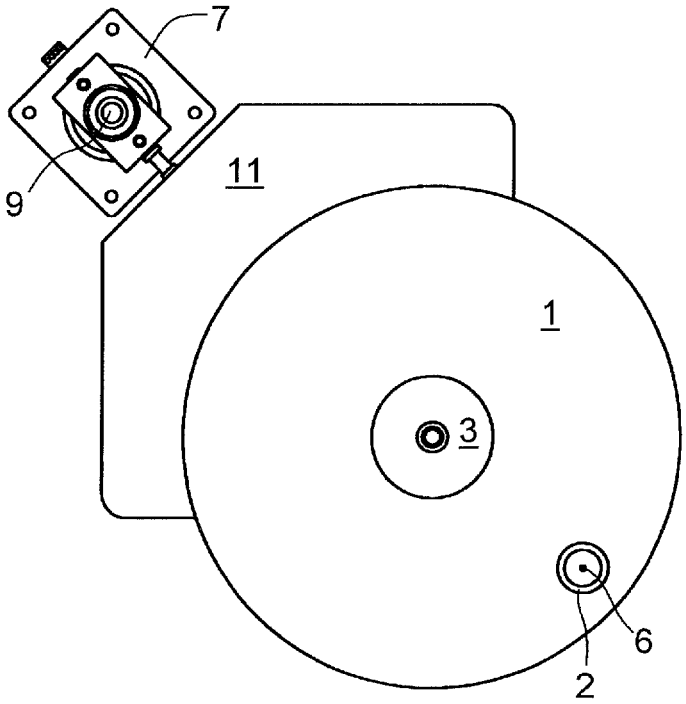
FIG. 11 shows a plan view and FIG. 12 shows an illustration in section along section line XII-XII of the grinding device from FIG. 9.
Figure 12:
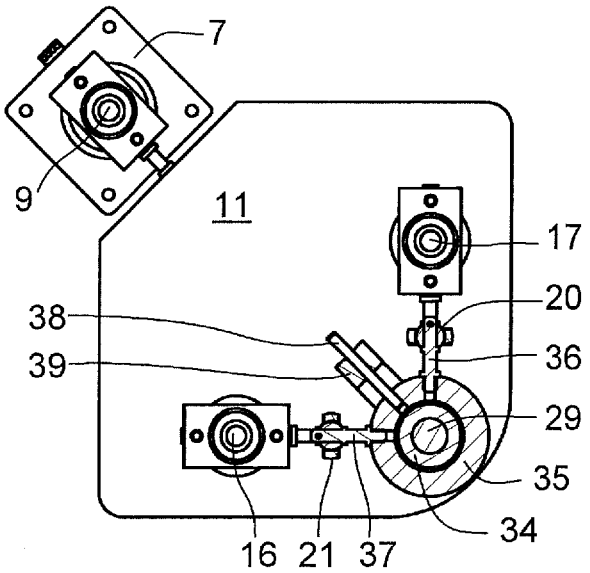
Figure 13:
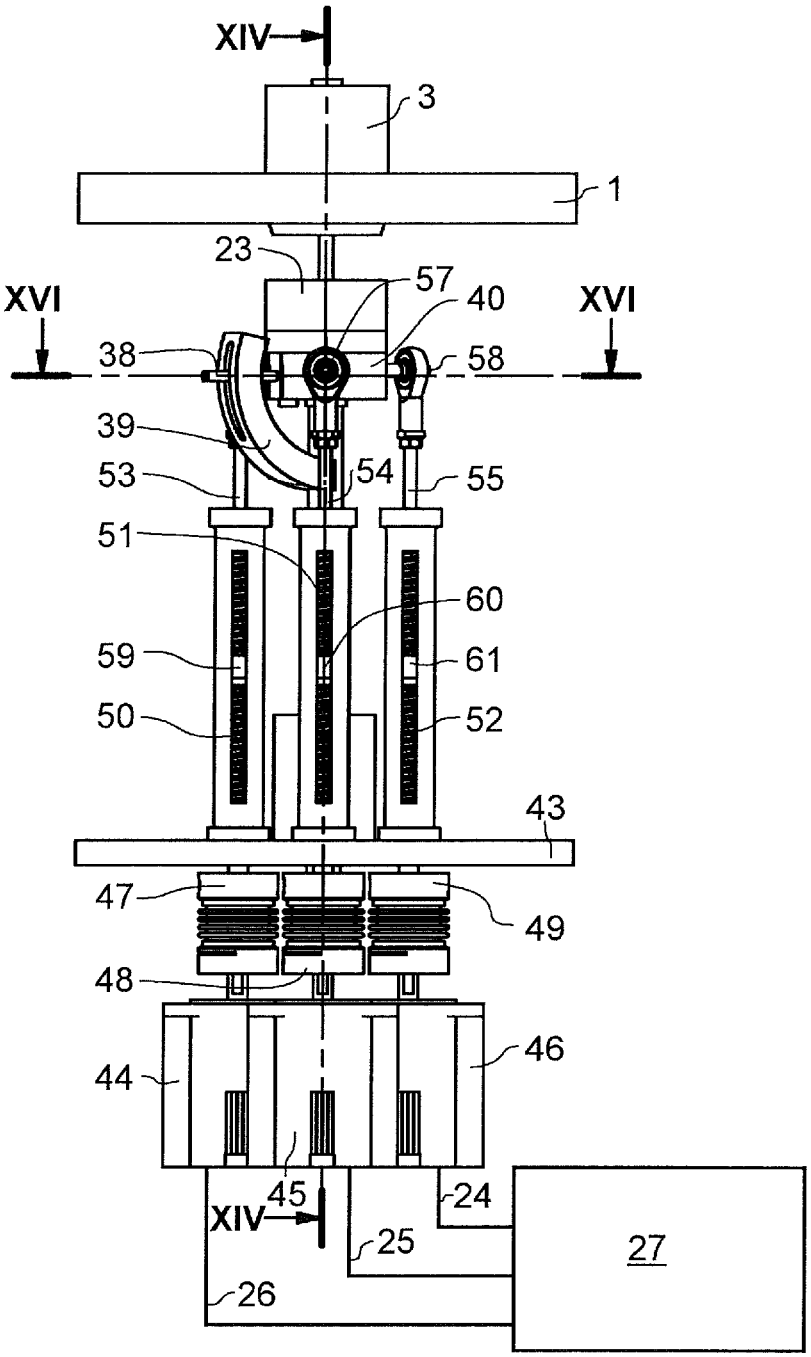
FIG. 13 shows a further embodiment of the grinding device described here.
Figure 14:
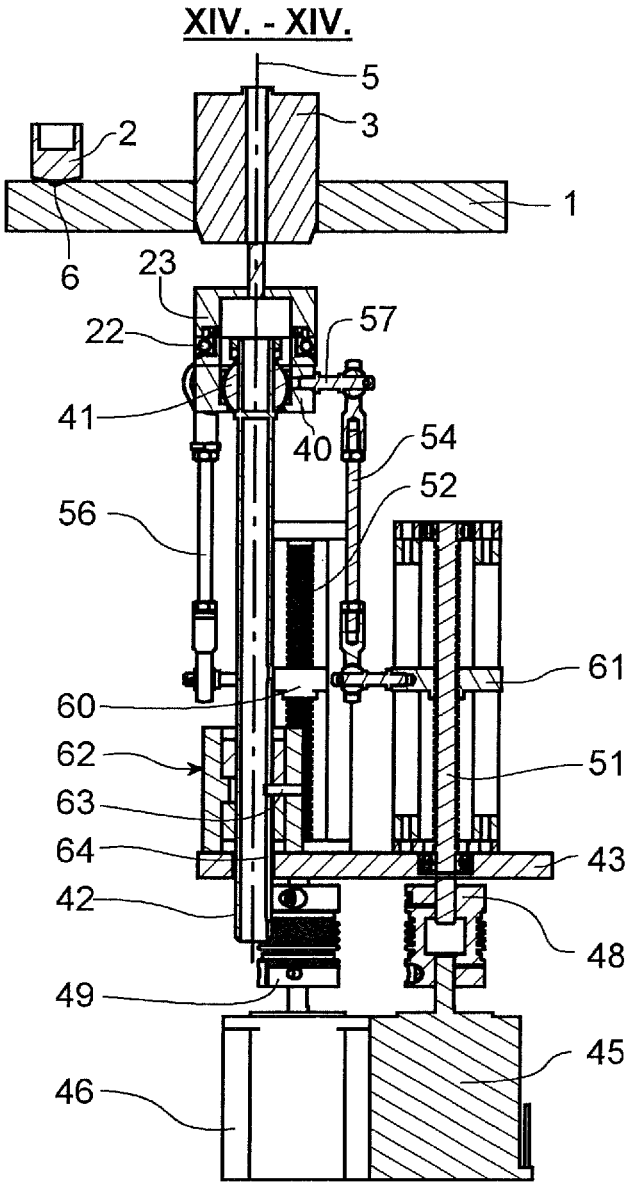
FIG. 14 shows an illustration in section along section line XIV-XIV of the grinding device from FIG. 13.
Figure 15:
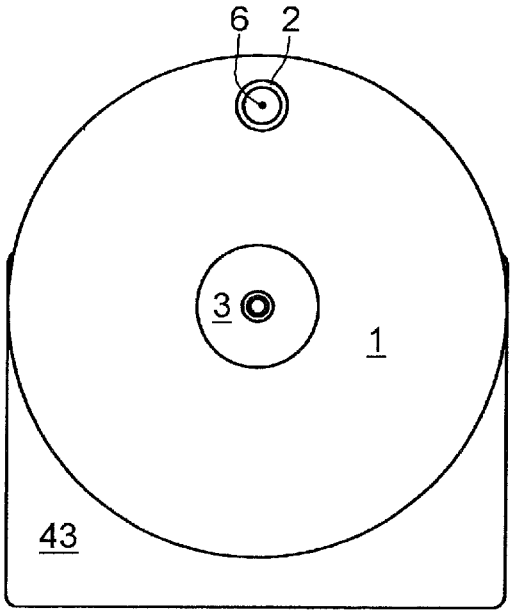
FIG. 15 shows a plan view and FIG. 16 an illustration in section along section line XVI-XVI of the grinding device from FIG. 13.
Figure 16:
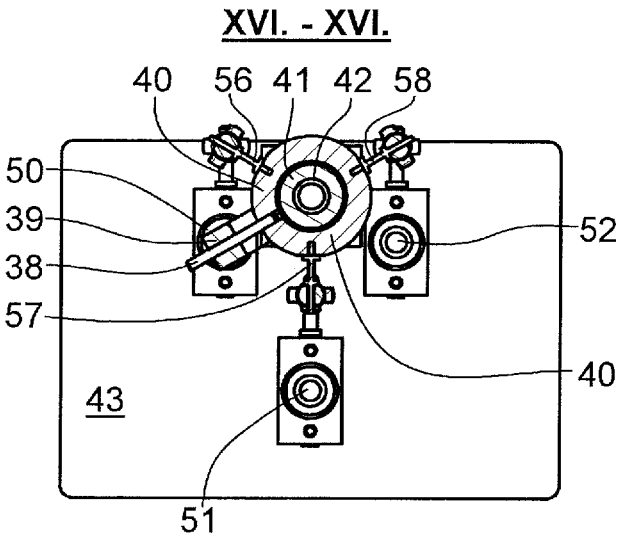

It can be seen in particular in FIG. 8 that the bearing carrier 32 in this embodiment is pivotable in any desired directions out of the horizontal plane by the universal joint 28. The universal joint 28 is arranged at the upper end of a holding rod 29, the lower end of which is fastened to the support plate 1. The universal joint 28 has an internal joint ring 30 which is fastened to the holding rod 29 so as to be pivotable about an internal axle pin 31. A second external joint ring 32 is pivotable about two external axle pins 33, 34. The two external axle pins 33, 34 extend at right angles to the internal axle pin 31. The actuating rod 20 pivots the external joint ring 32. The actuating rod 21 pivots the internal joint ring 30.

The actuating rods 20, 21 have at both of their ends ball joints by way of which they are coupled on one side to the spindle nuts 18, 19 and on the other side to the joint rings 30, 32 of the universal joint 28. As a result, the pivoting movements are compensated when the joint rings 30, 32 are actuated.

As mentioned, the external joint ring 32 serves as a bearing carrier for the bearing 22 (FIG. 6) of the grinding wheel 1. It can be seen that by using the universal joint 28 any desired pivoting of the bearing plane for the grinding wheel 1 and thus the main plane of the grinding wheel 1 itself out of the horizontal initial plane can be realized. The displacement of the grinding wheel 1 takes place by raising and lowering the support plate 1 using the threaded spindle 9 driven by the stepper motor 7. The actuating movements of the three actuators effect predictable shifts of the grinding wheel 1 such that, by using the digital control unit 27, the pivoting and displacement of the grinding wheel 1 can be controlled in such a way that, during the machining of a workpiece 2 which bears against the grinding wheel 1 in the region of the reference point 6, the desired contact between the surface of the workpiece 2 and the surface of the grinding wheel 1 can be achieved at any time. In this case, it is of course also possible for the workpiece 2 to be pressed against the grinding wheel 1 from below, unlike in the drawings.

With respect to the drawings described here, the terms up and down result from the selected position of the initial direction 5, which extends vertically in the drawings. This results in a horizontally extending initial plane, about which the grinding wheel 1 is freely pivotable. The initial direction can extend in any desired direction in space, wherein the initial plane and the components of the described device shift in a corresponding manner.

FIGS. 9 to 12 show an alternative embodiment of the grinding device. Identical components are provided with the same reference numbers in these figures as in FIGS. 5 to 8.

The essential difference here is that a ball joint 33 is fastened to the upper end of the holding rod 29. To be more precise, a ball 34 which carries a support ring 35 is fastened to the holding rod 29. The support ring 35 has an internal spherical bearing shell which is carried by the ball 34 so as to be pivotable about the horizontal plane. The support ring 35 forms the bearing carrier in this embodiment, wherein, here too, the bearing 22 for the grinding wheel 1 is a ball bearing.

In order to pivot the bearing carrier 35, the latter is connected to the actuating rods 20, 21 via connecting pins 36, 37. Unlike the universal joint 28 in FIG. 8, the ball joint 33 in FIGS. 9 to 12 cannot introduce any torques into the holding rod 29. For this reason, a cylindrical pin 38 is fitted on the bearing carrier 35 as a torque support 38. The pin 38 is held so as to be displaceable in a slot in a guide bracket 39. The guide bracket 39 is fastened to the holding rod 29, which is connected to the support plate 11 in a torque-proof manner. The pin 38 and the guide bracket 39 prevent the bearing carrier 35 from twisting on the ball 34 on account of torques that act on the grinding wheel 1.

Otherwise, this embodiment, too, allows the grinding wheel 1 to be displaced using the stepper motor 7, which raises and lowers the support plate in the vertical initial direction 5, and allows the grinding wheel 1 to be pivoted using the stepper motors 12, 13, which pivot the bearing carrier 35 in the form of a support ring.

The bearing carriers, i.e. both the external joint ring 32 of the universal joint 28 of the first embodiment (see in particular FIGS. 6 and 8) and the support ring 35 which is articulated in a pivotable manner on the ball 34 (FIGS. 10 and 12) are moved in the manner of a swash plate. They pivot about the horizontal plane and can be shifted in the vertical direction.

FIGS. 13 to 16 show an alternative embodiment in which the drive of the bearing carrier 40 is configured in a similar manner to the drive for a swash plate known from helicopter construction. In the embodiment in FIGS. 13 to 16, too, identical components are provided with the same reference numbers as in FIGS. 5 to 8.

In this embodiment, too, the bearing carrier 40 is mounted in a pivotable manner on a ball 41. The ball 41 is arranged at the upper end of a guide rod 42 which is mounted so as to be displaceable in the vertical direction with respect to a mounting plate 43. Three stepper motors 44, 45, 46 are fastened to the mounting plate 43 and are connected to three threaded spindles 50, 51, 52 via three metal bellows couplings 47, 48, 49. The metal bellows couplings 47-49 and the threaded spindles 50-51 are also fixedly arranged on the mounting plate 43. The threaded spindles 50-53 are each connected to the bearing carrier 40 via an actuating rod 53-55. The bearing carrier 40 has three fastening elements 56, 57, 58 which consist of spherical heads firmly screwed to the bearing carrier 40. The fastening elements 56, 57, 58 are connected to the actuating rods 53, 54, 55.

The bearing carrier 40 has the form of a support ring which is fastened to the ball 41 in a pivotable manner and to which a ring of the bearing 22 for the grinding wheel 1 is fastened. The fastening elements 56-58 fastened to the bearing carrier 40 are each arranged at an angular spacing of 120° around the circumference of the annular bearing carrier 40. If all the fastening elements 56, 57, 58 are raised or lowered synchronously, the bearing carrier 40 is shifted in the vertical direction without pivoting. If only one of the fastening elements 56, 57, 58 is actuated by the associated stepper motor 44, 45, 46, then the bearing carrier 40 pivots. The pivoted position and position of the bearing carrier 40 are unambiguously assigned to the positions of the three spindle nuts 59, 60, 61 on the threaded spindles 50, 51, 52. In the embodiment in FIGS. 13 to 16, too, the digital control unit 27 can effect any desired pivoted positions and displacements of the bearing carrier 40 by actuating the stepper motors 44, 45, 46, such that the grinding wheel 1 can be positioned by synchronous activation of the stepper motors such that a predetermined face, in particular a rotationally symmetrical surface, e.g. a conical surface or a surface in the form of a spherical cap, is produced around the reference point 6 on the end face of the workpiece 2.

In the case of the bearing carrier 40 in the form of a swash plate, it may likewise be necessary to pick up torque because this cannot be received via the ball 41. For this purpose, too, a pin 38 is fastened to the bearing carrier 40 which is guided in the slot of a guide bracket 39. The guide bracket 39 is fastened to the guide rod 42. In order that the guide rod 42 is held in a torque-proof manner with respect to the mounting plate 43, a linear bearing 62, which holds the guide rod 42 in a displaceable manner, is fastened to the mounting plate 43. The guide rod is tubular and has in its lower region a slot 64 in which a fixing pin 63 engages. Consequently, the torques of the bearing carrier 40 can be introduced into the guide bracket 39 via the pin 38 and are supported from here via the guide rod 42 and the fixing pin of the linear bearing with respect to the mounting plate 43.

The drive variants described here for the bearing carrier 40 by using stepper motors, metal bellows coupling and threaded spindle are illustrated schematically and described only by way of example. A multiplicity of other drive and coupling devices for transmitting the movement to the bearing carrier 40 are conceivable. What is essential is the displaceability of the bearing carrier 40 in an initial direction and the free pivotability of the bearing carrier 40 with respect to the initial plane, which extends perpendicularly to the initial direction.

Various embodiments discussed herein may be combined with each other in appropriate combinations in connection with the system described herein. Additionally, in some instances, the order of steps in the flow diagrams, flowcharts and/or described flow processing may be modified, where appropriate. Further, various aspects of the system described herein may be implemented using hardware, software, a combination of hardware and software and/or other computer-implemented modules or devices having the described features and performing the described functions. The system may further include a display and/or other computer components for providing a suitable interface with a user and/or with other computers.

Software implementations of aspects of the system described herein may include executable code that is stored in a computer-readable medium and executed by one or more processors. The computer-readable medium may include volatile memory and/or non-volatile memory, and may include, for example, a computer hard drive, ROM, RAM, flash memory, portable computer storage media such as a CD-ROM, a DVD-ROM, an SD card, a flash drive or other drive with, for example, a universal serial bus (USB) interface, and/or any other appropriate tangible or non-transitory computer-readable medium or computer memory on which executable code may be stored and executed by a processor. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A device for grinding solid workpieces, comprising:

a grinding wheel;

a bearing for the rotatable mounting of the grinding wheel about an axis of rotation;

a grinding wheel drive, which is coupled to the grinding wheel, for rotating the grinding wheel, wherein the bearing is fastened to a pivotable and displaceable bearing carrier, wherein the bearing plane of the bearing is pivotable in any desired directions with respect to an initial plane and is displaceable in an initial direction perpendicular to the initial plane;

actuators coupled to the bearing carrier in order to pivot and displace the bearing carrier; and a digital control unit that controls and synchronizes the actuators such that the surface of the grinding wheel creates a freely-definable face about a positionally fixed reference point which is at a radial distance from the center point of the grinding wheel.

2. The device according to claim 1, wherein the freely-definable face is rotationally symmetrical.

3. The device according to claim 1, further comprising:

a pivot joint which carries the bearing carrier in a freely-pivotable manner.

4. The device according to claim 3, wherein the pivot joint is a ball joint.

5. The device according to claim 3, wherein the pivot joint is a universal joint having two intersecting pivot axes.

6. The device according to claim 3, wherein the actuators include the following:

a first inclination adjustment drive for pivoting the bearing about a first pivot axis of the pivot joint;

a second inclination adjustment drive for pivoting the bearing about a second pivot axis, which intersects the first pivot axis, of the pivot joint; and a linearly-acting drive for displacing the bearing carrier.

7. The device according to claim 1, wherein the bearing carrier includes three fastening elements which are arranged at a distance from one another and to each of which an actuating rod, which is moved by at least one of the actuators, is fastened.

8. The device according to claim 7, wherein, in the case of a bearing plane extending parallel to the initial plane, each of the actuating elements is displaceable parallel to the initial direction using at least one of the actuators, by the actuating rod fastened thereto.

9. The device according to claim 1, wherein the grinding wheel drive is a hub motor, the rotor of which is connected to the grinding wheel in a torque-proof manner.

10. A method for grinding solid workpieces, in which a grinding wheel is mounted by a bearing so as to be rotatable about an axis of rotation and is driven by a grinding wheel drive, the method comprising:

fastening the bearing to a pivotable and displaceable bearing carrier, wherein the bearing plane of the bearing is pivotable in any desired directions with respect to an initial plane and is displaceable in an initial direction perpendicular to the initial plane, pivoting or displacing the bearing carrier using actuators; and controlling and synchronizing the actuators using a digital control unit such that the surface of the grinding wheel creates a freely-definable face about a positionally fixed reference point which is at a radial distance from the center point of the grinding wheel.

11. The method according to claim 10, wherein the freely-definable face is rotationally symmetrical.

12. The method according to claim 10, wherein the bearing carrier is held in a pivotable manner using a pivot joint.

13. The method according to claim 10, wherein the actuators include two inclination adjustment drives and a linearly acting drive, wherein the first inclination adjustment drive pivots the bearing about a first pivot axis of the pivot joint, wherein the second inclination adjustment drive pivots the bearing about a second pivot axis, which intersects the first pivot axis, of the pivot joint, and wherein the linearly acting drive displaces the bearing carrier.

14. The method according to claim 10, wherein the bearing carrier has three fastening elements which are arranged at a distance from one another and to each of which an actuating rod, which is actuated by at least one of the actuators, is fastened.

15. The method according to claim 14, wherein each of the fastening elements is displaced parallel to the initial direction by the actuating rod fastened thereto, using at least one of the actuators, when the bearing plane extends parallel to the initial plane.

* * * * *